US008499381B1

(12) United States Patent
Miller et al.

(10) Patent No.: US 8,499,381 B1
(45) Date of Patent: Aug. 6, 2013

(54) SLEEPING BAG FOR EXTENDED RANGE COLD WEATHER USE

(76) Inventors: Stephen D. Miller, Flagstaff, AZ (US); Christina L. LaChance, Flagstaff, AZ (US)

( * ) Notice: Subject to any disclaimer, the term of this patent is extended or adjusted under 35 U.S.C. 154(b) by 0 days.

(21) Appl. No.: 13/198,702

(22) Filed: Aug. 4, 2011

(51) Int. Cl.
*A47G 9/08* (2006.01)

(52) U.S. Cl.
USPC ..... 5/413 R; 2/69.5

(58) Field of Classification Search
USPC ..... 5/413 R, 413 AM, 417, 419, 420, 5/502, 655.9, 656; 2/69.5; 24/115 G
See application file for complete search history.

(56) References Cited

U.S. PATENT DOCUMENTS

| | | | | | |
|---|---|---|---|---|---|
| 3,959,834 | A * | 6/1976 | Hunt | 5/413 R |
| 4,329,747 | A * | 5/1982 | Russell | 5/420 |
| 4,420,521 | A * | 12/1983 | Carr | 428/74 |
| 4,888,828 | A * | 12/1989 | Tatsuno | 5/413 R |
| 4,894,878 | A * | 1/1990 | Roach | 5/413 R |
| 5,051,293 | A * | 9/1991 | Breitscheidel et al. | 428/157 |
| 5,533,216 | A * | 7/1996 | Thier | 5/413 R |
| 5,657,497 | A * | 8/1997 | Howe | 5/413 R |
| 5,711,032 | A * | 1/1998 | Carpenter | 2/158 |
| 6,018,830 | A * | 2/2000 | Howe | 5/413 R |
| 6,668,386 | B2 * | 12/2003 | Vidal | 2/100 |
| 6,711,766 | B2 * | 3/2004 | Monk et al. | 5/420 |
| 6,931,680 | B2 * | 8/2005 | Bellick et al. | 5/413 R |
| 7,051,387 | B1 | 5/2006 | Yoder | |
| 7,328,468 | B2 | 2/2008 | Korshamn | |
| 7,386,898 | B1 | 6/2008 | Brun | |
| 7,438,078 | B2 | 10/2008 | Woodruff | |
| 7,647,656 | B2 * | 1/2010 | Smith | 5/413 R |
| 7,849,535 | B2 * | 12/2010 | Tatsuno | 5/413 AM |
| 2007/0136946 | A1 | 6/2007 | Haislip | |
| 2008/0216234 | A1 | 9/2008 | Tatsuno | |
| 2008/0256705 | A1 | 10/2008 | Maguire | |
| 2009/0151071 | A1 | 6/2009 | Martin | |
| 2012/0297539 | A1 | 11/2012 | Like et al. | |

* cited by examiner

*Primary Examiner* — Michael Trettel

(57) ABSTRACT

Designs and methods are provided for an exemplary sleeping bag system comprising an outer sleeping bag having a first opening including a first zipper closure, a first integral hood including a first face opening, and a foot receiving region opposite said first face opening. The sleeping bag may further comprise an inner sleeping bag having a second opening including a second zipper closure, a second integral hood including a second face opening, and a foot receiving region opposite the second face opening. The inner sleeping bag may be connected to the outer sleeping bag by at least two connectors, one of which is proximate the foot receiving region.

25 Claims, 6 Drawing Sheets

Local Thermal Resistance and Heat Flux Values for the Bag System A

| No. | Body Segments On Zoned Manikin | Local Insulation Values (clo) | Local Heat Flux Levels (W/m$^2$) |
|---|---|---|---|
| 1. | Head | 6.19 | 53.3 |
| 2. | Right Arm | 6.84 | 48.2 |
| 3. | Left Arm | 6.94 | 47.5. |
| 4. | Right Hand | 6.34 | 52.0 |
| 5. | Left Hand | 6.58 | 50.1 |
| 6. | Chest | 12.47 | 26.5 |
| 7. | Back | 5.73 | 57.6 |
| 8. | Right Leg Front | 10.56 | 31.3 |
| 9. | Right Leg Back | 6.16 | 53.6 |
| 10. | Left Leg Front | 9.43 | 35.0 |
| 11. | Left Leg Back | 7.12 | 46.4 |
| 12. | Roght Foot | 4.92 | 67.1 |
| 13. | Left Foot | 4.55 | 72.6 |
| Total Body | | 7.45 | 48.8 |

SLEEPING BAG FOR EXTENDED RANGE COLD WEATHER USE

A portion of this invention was made with United States Government support under Government Contract/Purchase Order M67854-08-C-6534. The Government has certain rights in this invention.

TECHNICAL FIELD AND BACKGROUND

The present invention generally relates to sleeping bags; more particularly, to double sleeping bag systems having inner and outer bags.

BRIEF DESCRIPTION OF THE DRAWINGS

In the accompanying drawings.

Corresponding reference characters indicate corresponding parts throughout the several views. The exemplification set out herein illustrates one preferred embodiment of the invention, in one form, and such exemplification is not to be construed as limiting the scope of the invention in any manner.

DESCRIPTION OF THE EMBODIMENTS

Figure 2A:
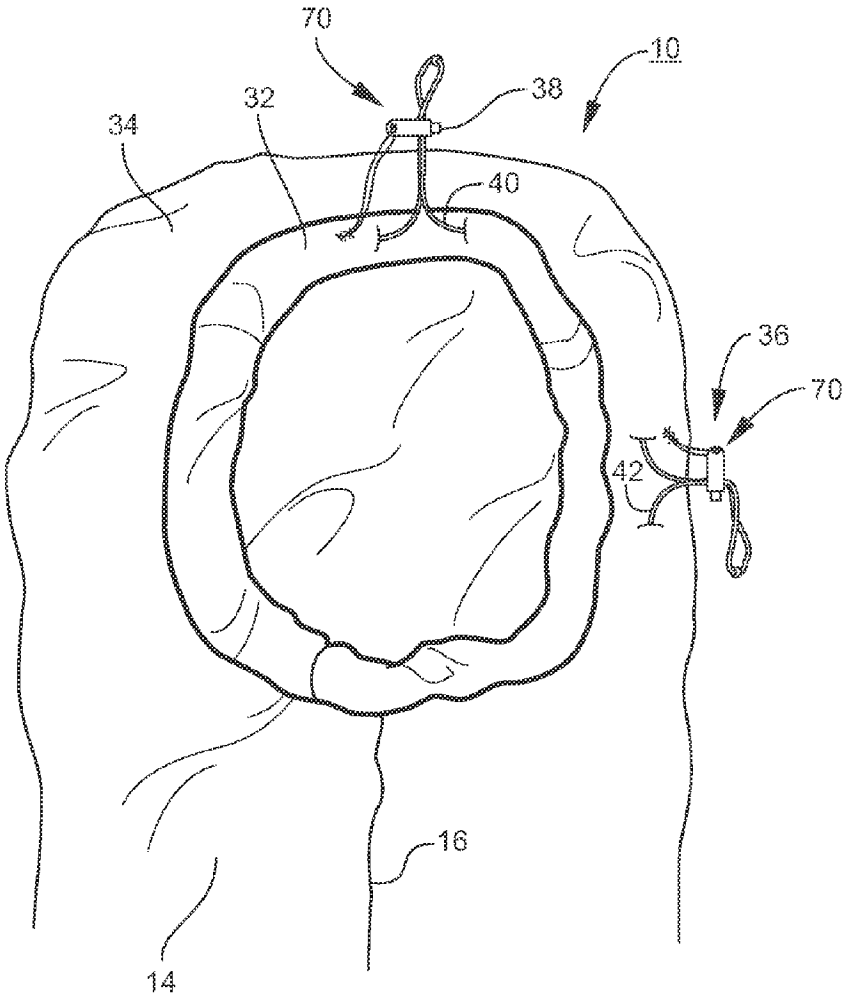
FIG. 2A is a plan view of a hood portion of a sleeping bag system in accordance with the present invention, showing the face opening of the inner bag being smaller than the face opening of the outer bag, showing the inner bag and outer bag drawstrings offset rotationally from one another about the respective face openings and also showing the drawstring toggles anchored to their respective hoods.

The instant invention is described more fully hereinafter with reference to the accompanying drawings and/or photographs, in which one or more exemplary embodiments of the invention are shown. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

A double bag Sleeping Bag System (SBS) in accordance with the present invention comprises an inner sleeping bag separably disposed within an outer sleeping bag, and may further include optionally a bivy bag (not shown) as is known generally in the prior art. Either of the inner bag and the outer bag may be used alone or with a bivy bag in warm sleeping conditions.

Figure 1:
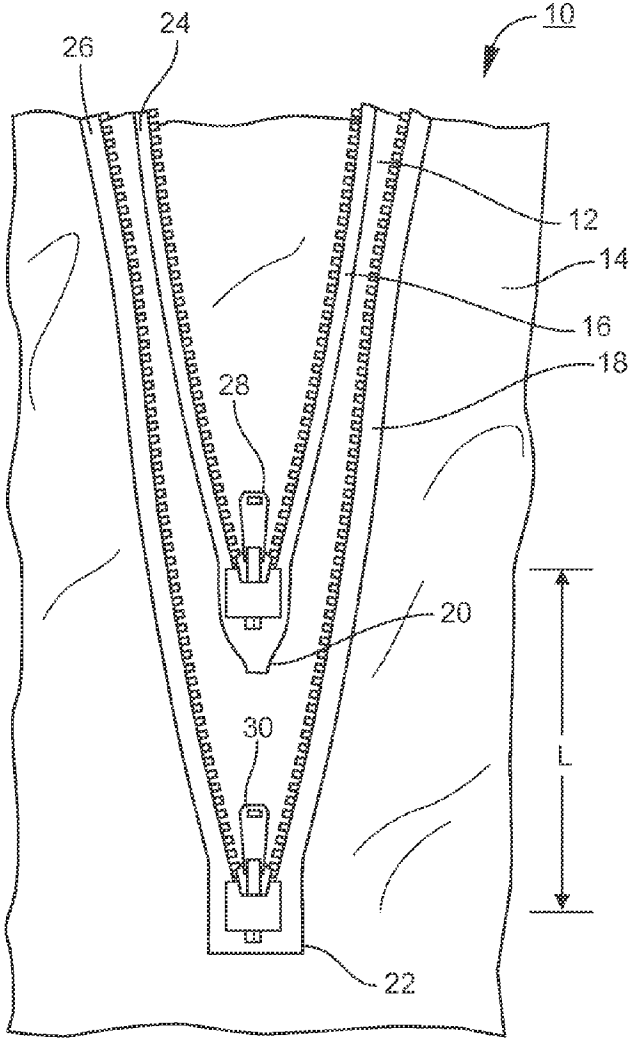
FIG. 1 is a plan view of a portion of a sleeping bag system in accordance with the present invention, showing the inner bag zipper being shorter than the outer bag zipper.

Referring to FIG. 1, in an exemplary double bag SBS 10, inner bag 12 is disposed generally concentrically within outer bag 14. Each bag 12,14 includes a respective zipper closure 16,18 originating at a respective closed first end 20,22 in a region of either bag at or below a user's chest of the outer bag and terminating at a variably open end 24,26 at or near a user's chin. The zipper opening of outer closure 18 at end 22 is longer than that of inner closure 16 at end 20 by a length L, preferably about 2 inches. This separation renders outer zipper pull 30 easily distinguishable from inner zipper pull 28 by a user, even in the dark. Further, outer zipper pull 30 cannot interfere with the full travel of inner zipper pull 28. This feature assures faster and more reliable egress from SBS 10.

Figure 2B:
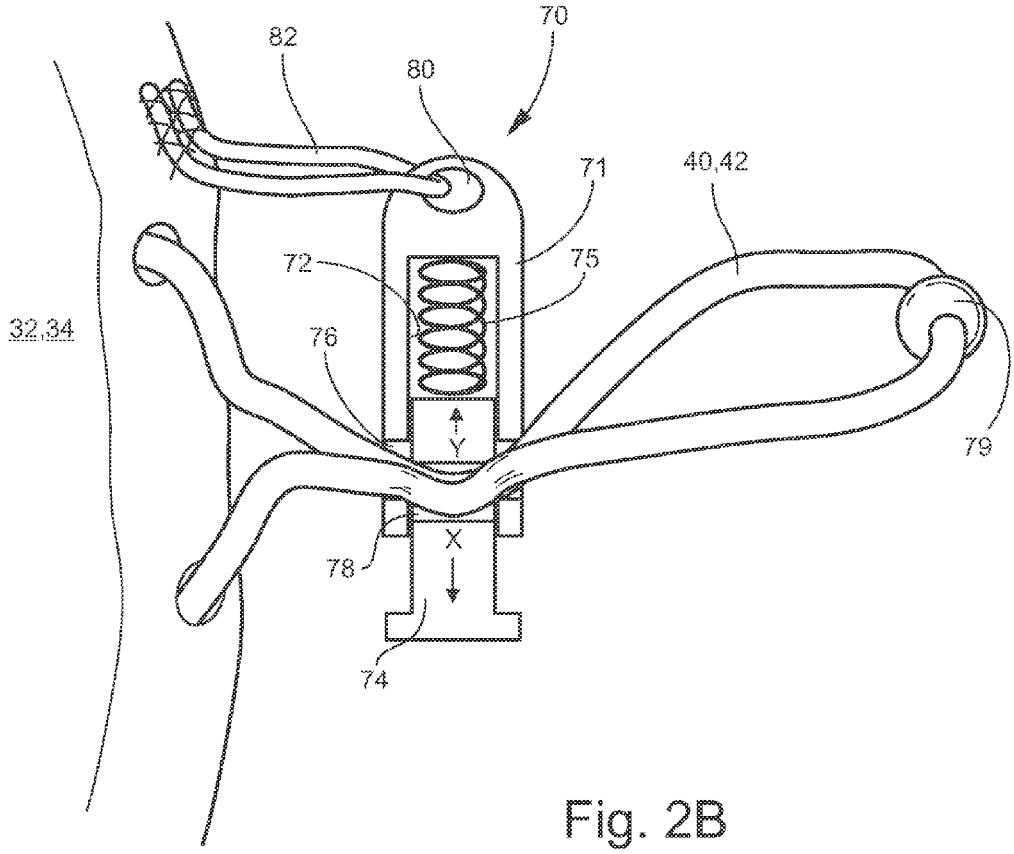
FIG. 2B is close-up, sectioned view of a toggle mechanism, drawstring and hood shown in FIG. 2A.

Referring to FIGS. 2A and 2B, double bag SBS 10 further comprises an inner hood 32 integral with inner bag 12 and an outer hood 34 integral with outer bag 14. Closure of inner hood 32 and outer hood 34 is important for body heat retention that otherwise would be lost through the head. The amount of closure is preferable adjustable, dictated by environmental conditions and personal preference. The adjustment allows the hood to be totally open to allow excess heat to escape in moderate climates, or the hood may be closed almost entirely to provide just enough opening to allow entry and exit of air for breathing. In accordance with the present invention, the drawstring face closure 36 of outer hood 34 is rotationally offset from the drawstring face closure 38 of inner hood 32 about the respective face openings, so the outer face closure 36 is easily distinguishable from inner face closure 38, even in the dark, and operations of the two face closures cannot interfere with each other. Preferably, inner bag draw string face closure 38 is secured at the top of the inner bag face opening, and outer bag draw string face closure 36 is secured at one side of the outer bag face opening, as shown in FIG. 2A. Once the drawstring face closure 36,38 is adjusted to its desired opening, drawstrings 40,42 are secured to the desired openings by spring toggles 70. Referring specifically to FIG. 2B, an exemplar toggle 70 is shown. Toggle 70 includes outer housing 71 forming an inner cylinder 72. Cylindrical button 74 is slidably disposed in inner cylinder 72 so that bias spring 75 pushes button outward from the inner cylinder in the direction shown as X. Housing 71 and button 74 include respective transverse passages 76,78. Passages 76,78 and are positioned so that when button 74 is pressed inward against the force of spring 75, transverse passages 76 and 78 are in alignment and when spring 75 is allowed to push button 74 outward, passages 76 and 78 are not in alignment. Passages 76,78 may be elliptically shaped in their cross-section and are sized to allow two thickness of drawstrings 40,42 to slidably pass through both transverse passages when the passages are aligned. Still referring to FIG. 2B, after drawstrings 40,42 are fed through their respective hoods 32,34, both ends of each drawstring are threaded through passages 76,78 then secured in an end loop by crimped ball 79. As best seen in FIG. 2B, when button 74 is allowed to be pushed outward by spring 75, the passages become misaligned thereby inhibiting free movement of the drawstrings through the passages and securing the amount of hood closure desired.

In prior art systems, since the togglers are not anchored to their respective hoods, two hands were needed to secure the amount of hood closure desired. One hand would be used to depressed button 74 in direction Y to align the passages and the other hand would be used to pull on the drawstrings near crimped ball 79. In one aspect of the present invention, only one hand is needed to secure the amount of hood closure needed to assure fast and reliable egress from SBS 10. Referring to FIG. 2B, toggles 70 include an orifice 80 at the base of housing 71. The toggles are tethered to their respective hoods 32,34 by tether string 82 passing through orifice 80. The ends of tether string 82 may be secured to the respective hoods by sewing, for example. In use, only one hand is needed to pull on the drawstrings near crimped ball 79 to secure the amount of hood closure needed. The tether holds toggle in position near the hood so that drawstrings 40,42 can be pulled through the misaligned passages against the resisting force of the bias spring. The force exerted by the bias spring on the drawstrings to resist movement would be selected to assure retention of the drawstrings for securing the amount of hood closure desired and to assure that the drawstrings could be pulled through misaligned passages. In yet another aspect of the invention, the drawstrings may be made of an elastic material. As the elastic drawstring is pulled, it stretches and its diameter reduces. The reduced diameter of the drawstring will help the drawstring slide through misaligned passages of the toggle in the one-handed operation.

In yet another aspect of the invention, the drawstring of either the inner hood closure or the outer hood closure, or both, may be configured so that the closure(s) are adjustable, from side-to-side. In this embodiment, the respective drawstring may be anchored to the hood at two points 180° apart from one another around the peripheral opening of the hood. Then, by placing a first toggle approximately 90° from one of the anchor points and a second toggle approximately 180° from the first toggle, each 180° segment of the hood closure can be made independently adjustable. This embodiment could provide one-sided adjustability of the closure if, say, the user slept on his/her side.

Figure 3:
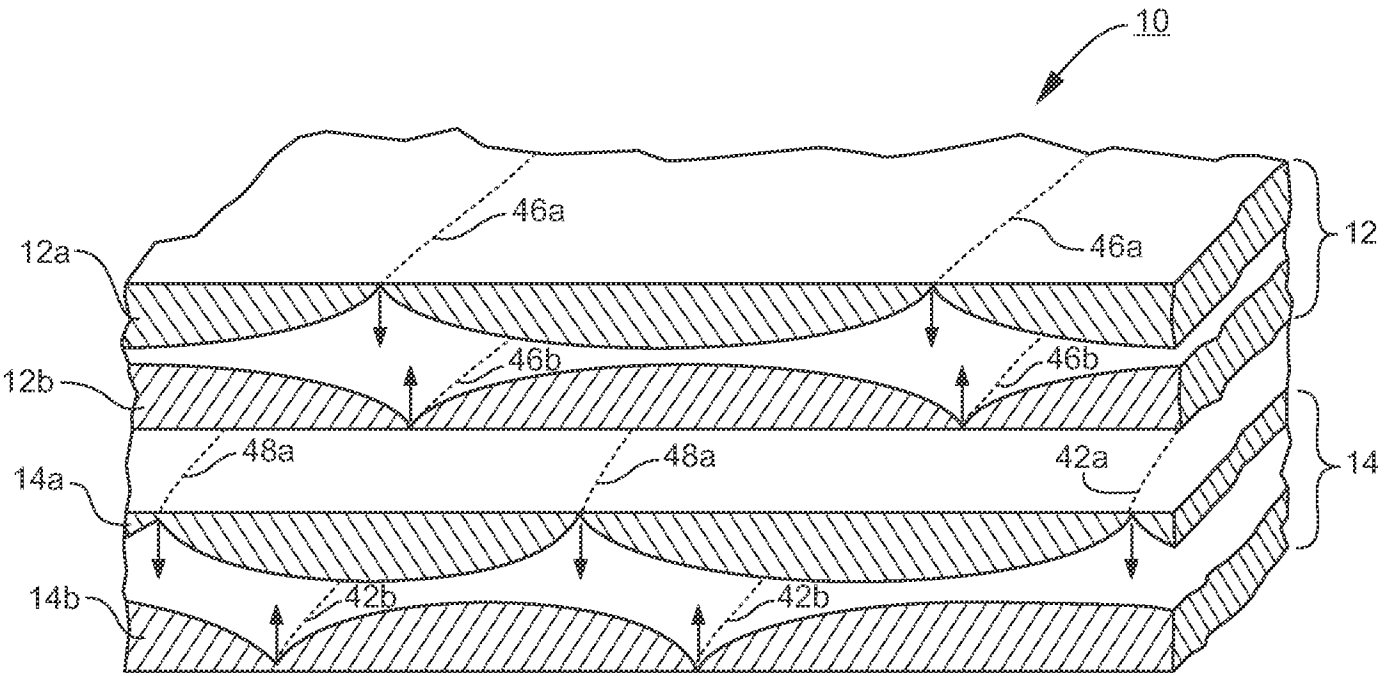
FIG. 3 is an isometric view of a portion of a sleeping bag system in accordance with the present invention, showing quilting seams offsets in the outer bag and the inner bag.

Referring to FIG. 3, inner bag 12 and outer bag 14 are shown. Each of the inner bag and outer bag includes a respective inner layer 12*a*, 14*a* and outer layer 12*b*, 14*b*. Quilt seams formed in the inner bag and the outer bag layers during assembly create areas where the insulation is compressed. Such quilt seams may be continuous or discontinuous; and comprise stitching, or various bonding techniques such by pressure bonding, ultrasonic bonding, lamination, and the like. If adjacent quilting seams are aligned, as can happen in prior art sleeping bags, then heat can escape more readily through the aligned seams. In the present SBS invention, the quilt seams 46*a*,46*b* of respective layers of inner bag 12, and 48*a*,48*b* of respective layers of outer bag 14 may be deliberately offset between each layer and between the inner bag and outer bag to prevent easy loss of heat through compressed areas of quilting insulation.

Seam non-alignment may also be achieved by incorporating quilting seams that are substantially non-linear, while providing other advantages. For example, curved quilting seams, when used on the side of the sleep system, will bring the insulation closer to the body, which helps avoid air movement within the bag, without creating seam alignments. Additionally, a pattern of quilting, such as but not limited to a chevron pattern, will force the insulation to reach a greater loft over the chest area where there is no additional compression from the body. Those skilled in the art will appreciate that other inherently non-aligning quilting shapes and patterns are possible and certainly foreseeable in view of the present disclosure.

Figure 4A:
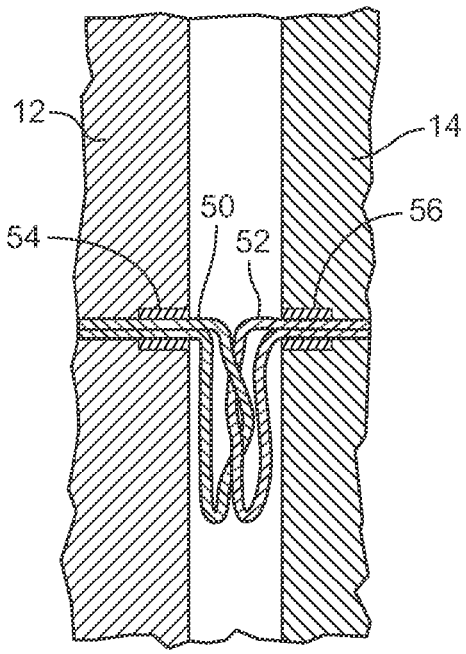
FIG. 4A is a cross-sectional view of exemplary connectors between the inner bag and the outer bag as employed in a sleeping bag system in accordance with the present invention.
Figures 4B, 5:
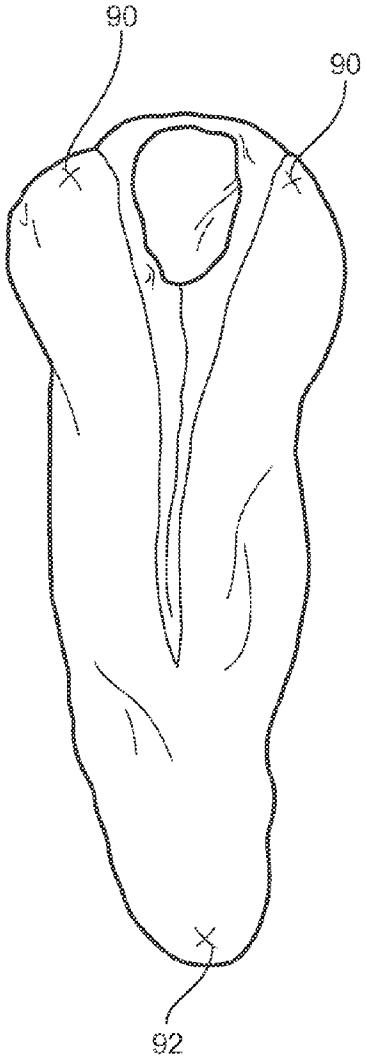
FIG. 4B is a plan view of the sleeping bag system, in accordance with the invention, showing the locations of the connectors shown in FIG. 4A.
FIG. 5 is a chart showing local insulation values and heat flux levels in various body segment zones.

The inventors have discovered that even though the outer bag of prior art systems may be removably attached to the inner bag at the shoulder and head regions, twisting of the bags relative to each other can and does occur in the feet region. Referring to FIGS. 4A and 4B, inner bag 12 and outer bag 14 are positively aligned and removably connected at the shoulders 90, top of the head (not shown), and also at the feet 92 to prevent twisting of the inner bag with respect to the inner bag throughout the entire length of the SBS and to assist in preventing alignment of the quilt stitching between the inner bag and the outer bag as described above. Alignment connectors 50,52, sewn into seams 54,56 of inner bag 12 and outer bag 14, respectively, may be non-metallic elements such as mating hook and loop cloth or plastic elements to help in minimizing heat transfer between the inner bag and the outer bag and increasing user comfort. Alternatively, the connectors may be fabric straps with snaps, or short lengths of lace or cord that can be tied together, or fabric straps with buttons. In one particular embodiment each element is loop-shaped and extends along the seam for preferably about two inches.

In one embodiment, insulation for keeping a user warm while sleeping is distributed non-uniformly within the SBS, i.e, to provide greater insulation amount or effectiveness where it is needed most by a user. For example, insulation in the outer bag may be optimized to complement the inner bag insulation to provide a total amount of insulation required in each body location to bring the overall warmth to the required level. This may be accomplished by using data from heat loss measurements made to determine how much more effective insulation is required in the various body areas to meet the requirement.

Referring to FIG. 5, measurements of local insulation values and local heat flux levels taken at various body points are shown. Using the measured local heat flux values as a guide, for example, more insulation can be placed in areas where a higher heat flux value is indicated. Using these test measurements, optimum placement of the insulation can be achieved. For example, based on an indication that the greatest heat loss is experienced in the foot area, more insulation can be strategically placed there and lesser amounts near the front of the legs where a lesser amount of heat loss is experienced. Thus, the bag can be made more comfortable and lighter in weight. Alternatively the insulation can be optimized for survivability to provide more insulation for the core of the body and less for the legs.

In one embodiment, the insulating capability of the SBS may be further enhanced with an inner lining of one or both sleeping bags made from a reflective fabric. The reflective fabric may be breathable or non-breathable. Without wishing to be bound by any particular theory of operation, a breathable reflective fabric may increase thermal resistance and reduce microbial activity leading to body odor; while a non-breathable fabric may reduce reflective heat loss, and reduce both condensation buildup and microbial activity inside the sleeping bags.

Figure 6:
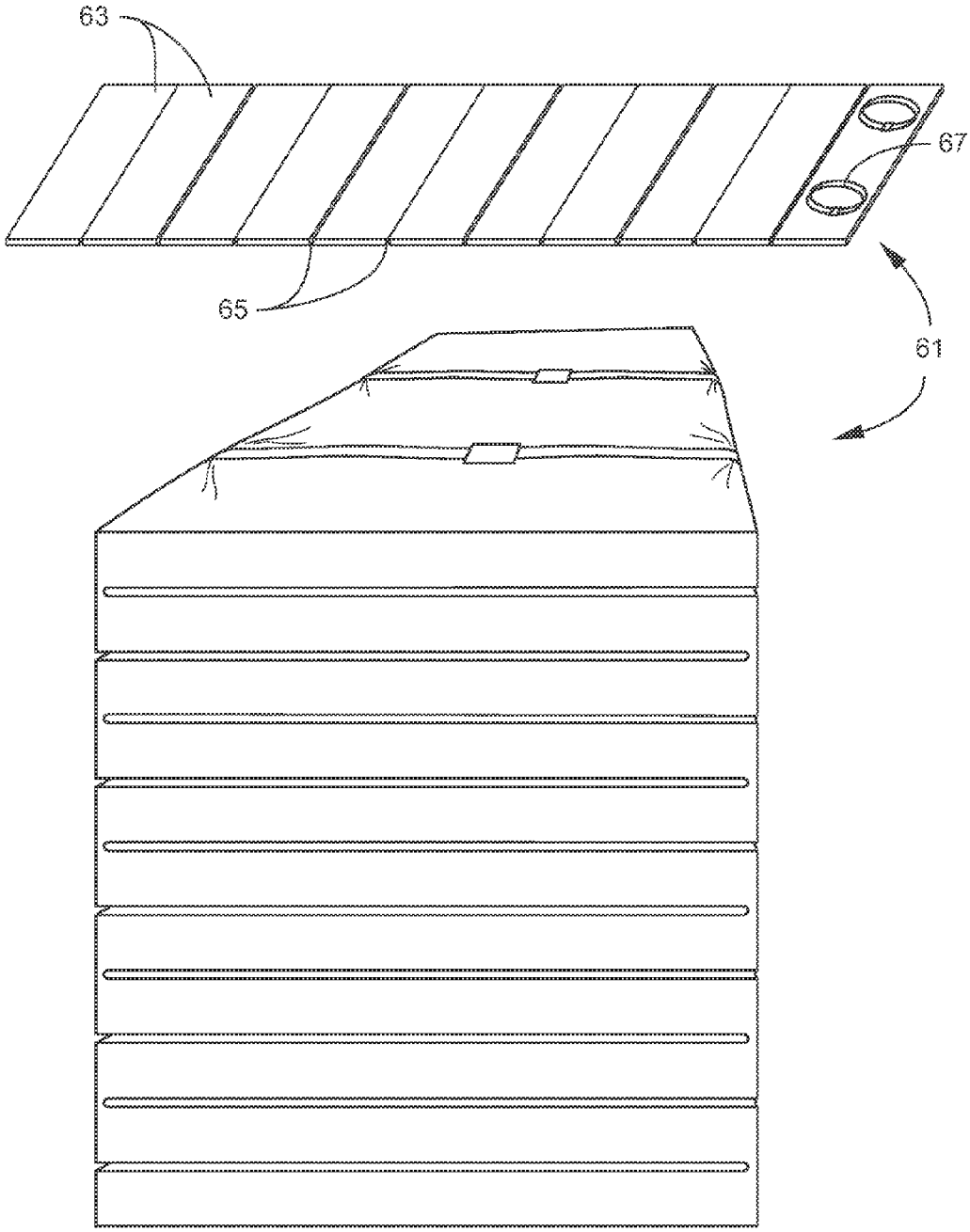
FIG. 6 is perspective views of an exemplary foldable sleeping pad.

Referring now to FIG. 6, an exemplary SBS may further comprise a foldable sleeping pad 61 comprising sections of foam 63. The sides of adjacent foam sections may be connected to one to another with a flexible material 65 that works as a hinge, allowing the sections to fold and unfold in accordion fashion. The foam sections may have a flat shape so as not to retain water in any convolutions. The foldable sleeping pad may further comprise one or more straps or elastic loops 67 to hold it in the folded condition for easy storage and transport.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subj ect matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under §112, 6th paragraph is not intended. Additionally, it is not intended that the scope of patent protection afforded the present invention be defined by reading into any claim a limitation found herein that does not explicitly appear in the claim itself.

What is claimed is:

1. A sleeping, bag system comprising:

an outer sleeping bag having a first opening including a first zipper closure, a first integral hood including a first face opening, and a foot receiving region opposite said first face opening; and an inner sleeping bag having a second opening including a second zipper closure, a second integral hood including a second face opening, and, a foot receiving region opposite the second face opening, wherein the inner sleeping bag is connected to the outer sleeping bag by at least two connectors, one of which is proximate the foot receiving region, and wherein the first integral hood includes a first drawstring closure, and the second integral hood includes a second drawstring closure, and wherein the respective drawstring closures are rotationally offset from one another about the respective face openings.

2. The sleeping bag system in accordance with claim 1 wherein the connectors are non-metallic.

3. The sleeping bag system in accordance with claim 1, wherein the connectors are selected from the group comprising: fabric straps with snaps; lengths of lace or cord that can be tied together; and fabric straps with buttons.

4. The sleeping bag system in accordance with claim 1, wherein the at least two connectors further comprise connectors proximate the shoulders and top of the head.

5. The sleeping bag system in accordance with claim 1 wherein the outer sleeping bag comprises at least one layer having a first quilting seam, the inner sleeping bag comprises at least one layer having a second quilting seam, and wherein the first and second quilting seams are not in alignment with each other.

6. The sleeping bag system in accordance with claim 1 wherein at least one of the inner bag or the outer bag includes an inner layer having a first quilting seam and an outer layer having a second quilting seam, and the at least one of the inner bag or outer bag is configured so that the first and second quilting seams are not in alignment with each other.

7. The sleeping bag system in accordance with claim 1 wherein one of the first drawstring closure or the second drawstring closure is positioned at one side of the first respective face opening, and the other of the first drawstring closure or the second drawstring closure is positioned at the top of the respective face opening.

8. The sleeping bag system in accordance with claim 1 wherein the first drawstring closure includes a first toggle, and the second drawstring closure includes a second toggle, and wherein at least one of the first or second toggles is tethered to its respective integral hood.

9. The sleeping bag system in accordance with claim 1 wherein least one of the first or second drawstrings closures is formed of an elastic material.

10. The sleeping bag system in accordance with claim 1 wherein insulation in at least one of the inner and outer sleeping bags is distributed non-uniformly based upon heat loss characteristics of a user to provide greater and lesser insulation effectiveness where needed more and less by various portions of the users body.

11. The sleeping bag system in accordance with claim 1, wherein the distribution of insulation in at least one of the inner and outer sleeping bags is optimized for survivability to provide more insulation for the core of the body and less for the legs.

12. The sleeping bag system in accordance with claim 1, wherein each of the first and second zipper closures originates at a respective closed first end and terminates at a respective openable end near the respective first and second face openings, and wherein the first zipper closure at the first closed end extends a length L beyond the second zipper closure at the second closed end.

13. The sleeping bag system in accordance with claim 1, wherein an inner lining of one or both of the inner and outer sleeping bags is made from a reflective fabric.

14. The sleeping bag system in accordance with claim 13, wherein the reflective fabric is breathable.

15. The sleeping bag system in accordance with claim 1, further comprising a sleeping pad made of a plurality of flat sections of foam having sides connected to with a flexible material allowing the pad to fold and unfold in accordion fashion.

16. The sleeping bag system in accordance with claim 15, wherein the sleeping pad further comprises one or more straps or elastic loops to hold it in the folded condition.

17. A sleeping bag, system comprising:

an outer sleeping bag having a first opening including a first closure, a first integral hood, and a foot receiving region opposite the first integral hood; and an inner sleeping bag having a second opening including a second closure, a second integral hood, and a foot receiving region opposite the second integral hood;

a plurality of quilting seams disposed about layers of the inner and outer sleeping bags, wherein adjacent quilting seams are substantially non-aligned, and wherein the first integral hood includes a first drawstring closure, and the second integral hood includes a second drawstring closure, and wherein the respective drawstring closures are rotationally offset from one another about the respective face opening.

18. The sleeping bag system of claim 17, wherein the adjacent quilting seams comprise a first quilting seam in a first layer of one of the inner or outer sleeping bag, and a second quilting seam in a second layer of the same one of the inner or outer sleeping bags.

19. The sleeping bag system of claim 17, wherein the adjacent quilting seams comprise a first quilting seam in a layer of the inner sleeping bag, and a second quilting seam in a layer of the outer sleeping bag.

20. The sleeping bag system of claim 17 wherein at least one of the adjacent quilting seams is non-linear.

21. The sleeping bag system of claim 17, wherein the quilting seams comprise curved seams, angled seams, and seams in geometric patterns.

22. The sleeping bag system of claim 17, wherein the quilting seams comprise a chevron pattern.

23. A sleeping bag system comprising:

an outer sleeping bag having a first opening with a first integral hood, the first integral hood including a first face opening and a first drawstring closure; and an inner sleeping bag having a second opening with a second integral hood, the second integral hood including a second face opening and a second drawstring closure, and wherein the respective drawstring closures are rotationally offset from one another about the respective face openings.

24. The sleeping bag system of claim 23, wherein one of it drawstring closure or the second drawstring closure is positioned at one side of the first respective face opening, and the other of the first drawstring closure or the second drawstring closure is positioned at the top of the respective face opening.

25. The sleeping bag system of claim 23, wherein the first integral, hood includes a first drawstring closure including a first toggle, and the second integral hood includes a second drawstring closure including a second toggle, and wherein at least one of the first or second toggles is tethered to its respective integral hood.

* * * * *